United States Patent [19]

Mitchell et al.

[11] 4,179,000

[45] Dec. 18, 1979

[54] SELF-CLEANING RAISE BORING HEAD SYSTEM

[75] Inventors: Howard E. Mitchell, Duncanville; William C. Saxman, Irving, both of Tex.

[73] Assignee: Dresser Industries, Inc., Dallas, Tex.

[21] Appl. No.: 912,624

[22] Filed: Jun. 5, 1978

[51] Int. Cl.[2] ..... E21C 23/00

[52] U.S. Cl. ..... 175/53; 299/90; 175/344

[58] Field of Search ..... 175/53, 334, 344, 335, 175/341, 345, 346, 347, 391, 62, 308–312; 299/90

[56] References Cited

U.S. PATENT DOCUMENTS

| | | | |
|---|---|---|---|
| 1,639,215 | 8/1927 | Grassi | 299/90 X |
| 2,384,394 | 9/1945 | Ramsay | 175/94 |
| 2,633,334 | 3/1953 | Lavender | 175/62 X |
| 2,775,439 | 12/1956 | McCarthy | 175/53 |
| 3,355,215 | 11/1967 | Haspert et al. | 299/90 |
| 3,444,939 | 5/1969 | Bechem | 175/334 |
| 3,508,620 | 4/1970 | Pennington | 175/53 |
| 3,659,660 | 5/1972 | Conn | 175/53 |
| 3,830,318 | 8/1974 | Busby et al. | 175/53 |
| 4,009,909 | 3/1977 | Robbins et al. | 175/94 |

FOREIGN PATENT DOCUMENTS

| | | | |
|---|---|---|---|
| 1488917 | 6/1967 | France | 175/53 |

*Primary Examiner*—James A. Leppink
*Assistant Examiner*—Richard E. Favreau
*Attorney, Agent, or Firm*—Eddie E. Scott

[57] ABSTRACT

The body of a raise boring head is produced from a truncated cone. A variety of efficient and economical methods such as spin-forming, casting, rolling, etc. may be used in producing the truncated cone body. A multiplicity of rolling cutters positioned in cutter saddles are mounted on the truncated cone body. The mounting surfaces for the cutter saddles are on a continuous plane. The continuous plane can be produced on the truncated cone body in one turning operation. The raise boring head is self-cleaning due to the natural tendency of the cuttings to slide toward the periphery of the truncated cone body surface. The overall gross weight of the raise boring head is reduced and the strength-to-weight ratio is increased. The structural rigidity of the raise boring head is improved even though many of the structural components used in prior art raise boring heads have been eliminated.

2 Claims, 2 Drawing Figures

SELF-CLEANING RAISE BORING HEAD SYSTEM

FIELD OF THE INVENTION

The present invention relates to the art of earth boring and, more particularly, to a self-cleaning raise boring head for boring raise holes by enlarging a pilot hole into a larger diameter raise hole.

BACKGROUND OF THE INVENTION

It is well known in the art to produce a relatively large diameter hole between a first location and a second location in a mine or other underground works by an operation commonly referred to as raise drilling. A raise drilling operation begins by drilling a small diameter pilot hole through the earth from a first location to an opening at the second location using a small diameter pilot bit. After the pilot hole is completed, the pilot bit is removed from the drill string and a large diameter raise head or raise bit is attached to the drill string. The raise head is rotated and drawn along the pilot hole thereby enlarging the pilot hole to the desired size.

Many strict requirements are imposed upon a raise head that is used in boring a large diameter raise hole. The raise head must be a balanced, high-performance apparatus that is rugged and will perform for a long period of time. Raise boring heads of this type use replaceable rolling cutters located and space so that upon rotation of the raise head every portion of the hole being drilled will be acted upon by one or more of the cutters in order to disintegrate the formations and form the desired raise hole. This insures that almost the entire wear in drilling takes place on the cutters rather than on the main raise head body. The cutters are readily replaceable thereby allowing the life of the raise head to be extended by replacing the individual cutters.

Traditionally, raise boring heads have been manufactured by welding together a series of plates, gussets, stiffeners, and rolls. Each individual cutter saddle location was separately machined. This involved substantial problems because of the time for set-up and machining. The body of the prior art raise boring heads included a network of horizontal plates arranged around the central drive stem. This did not permit all of the falling debris to escape the confines of the body portion of the raise boring head. The build-up of debris impeded performance of the raise head and reduced the life of the head.

Description of Prior Art

In U.S. Pat. No. 3,220,494 to R. E. Cannon et al, patented Nov. 30, 1965, a raise boring system is shown wherein a pilot hole is enlarged to the desired size by rotating and drawing a large diameter bit upward along the pilot hole. This operation places a great amount of wear and stress upon the large diameter bit; consequently, a need exists for a large diameter bit that will stand up under severe drilling conditions. It is desirable to keep the costs of the bit as low as possible. In order to do this, the amount of high-cost materials used in the bit should be held to a minimum. The process of manufacturing the bit should be carried out in the most economical manner possible and the lifetime of the bit should be long.

In U.S. Pat. No. 3,659,659 to Carl L. Lichte, patented May 2, 1972, a bit for boring a large diameter hole is shown. The body of the bit includes a multiplicity of stages around a central axis. The bit is attached to the drill column by a replaceable stem connected to the main body of the bit and the body of the bit includes a series of plates separated by a series of hollow support elements.

In U.S. Pat. No. 3,633,691 to Milton L. Talbert, patented Jan. 11, 1972, a bit for drilling large diameter holes is shown. Cutters are arranged in a staged configuration around the central shaft. The innermost cutters are the same large cutters used at other locations on the bit allowing complete interchangeability. The innermost cutters are turned inward. This reduces the uncut bottom next to the pilot hole and provides a stronger bit because the central shaft has not been weakened by milling or other operations.

Raise boring heads utilizing a cast dome structure are known. Each saddle location on this type of raise boring head must be individually machined and is a costly operation. The manufacturing process involves a number of machining set-up steps which are expensive to control and monitor for quality.

SUMMARY OF THE INVENTION

The present invention provides a raise boring head and a method of manufacturing a raise boring head that is greatly simplified over the prior art raise heads and manufacturing systems. The foundation of the raise boring head of the present invention is a conical main plate that forms the primary framework basis of the raise head. The surface of the conical main plate diverges downwardly toward the outer periphery of the raise head. The conical main plate is provided by producing a truncated cone. Greater flexibility, economy and efficiency are provided in manufacturing the truncated cone because it can be formed by casting, rolling, spin-forming, etc. The truncated cone is much more structurally sound and provides greater rigidity than the series of fabricated plates used in prior art raise heads. Many of the prior art structural components have been eliminated from the raise head of the present invention. This provides a reduction in material resulting in cost savings and a reduction in weight of the raise head. Accordingly, a high strength-to-weight ratio is provided by the present invention. The simplification of machining reduces the manufacturing time involved in producing the raise head of the present invention thereby providing a cost savings. The mounting surfaces for the rolling cutter saddles is a single continuous plane. This mounting surface can be machined in a single turning operation with a single machining set-up. The rolling cutter face profile is generally parallel to the conical surface of the main plate. The raise head of the present invention is self-cleaning in up-drilling raise boring operations. The cuttings produced during the up-reaming operation will fall free of the raise head. This provides a smoother running raise head thereby improving the operational performance of the raise head. The lifetime of the raise head is increased because there will be less wear on the rolling cutters. The present invention provides a reduction in wear on the rolling cutters normally produced by the cutters scrubbing against build-up debris on the body of the raise head. The raise head of the present invention will clean itself of debris falling from the formation face. The above and other features and advantages of the present invention will become apparent from a consideration of the following detailed description of the invention when taken in conjunction with the accompanying drawings.

DETAILED DESCRIPTION OF THE INVENTION

Figure 1:
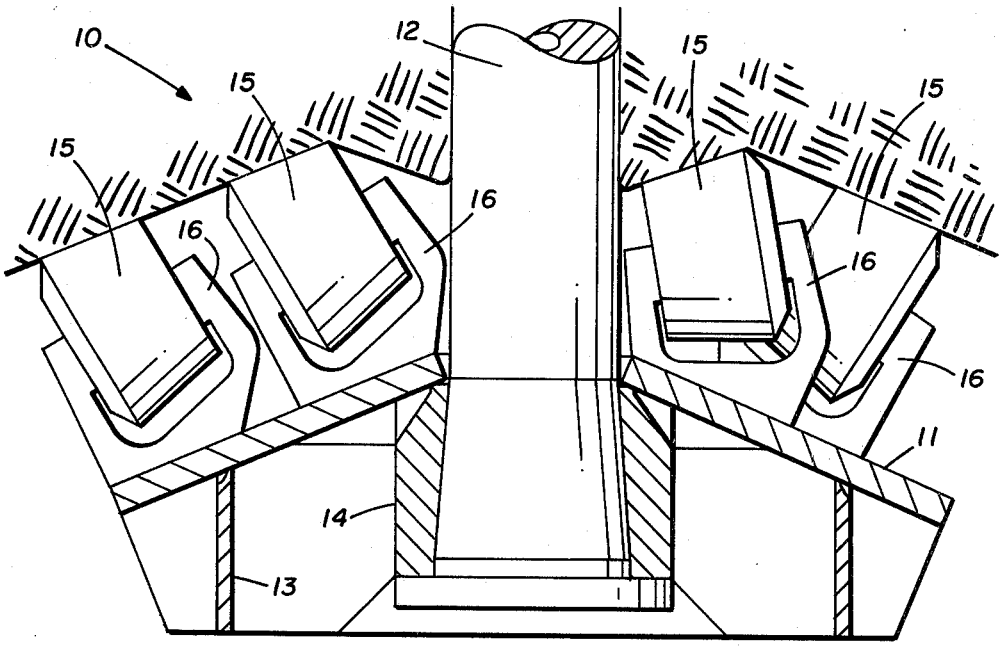
FIG. 1 is a side view, partially in section, of a raise head of the present invention.

Referring now to the drawings and, in particular, to FIG. 1, the raise boring head of the present invention and the method of manufacturing a raise boring head in accordance with the present invention will be illustrated. The raise boring head is generally designated by the reference number 10. A conical main plate 11 forms the basic framework of the raise boring head 10. The main plate 11 comprises a truncated cone. The main plate 11 may be produced by various methods of manufacturing such as spinforming, casting, rolling, etc. A central drive stem 12 projects through a central opening in the conical main plate 11. The upper portion of the drive stem 12 is threaded to allow the raise head 10 to be easily connected to, and disconnected from, a rotary drill string (not shown). During the boring of a large diameter raise hole, a small diameter pilot hole is initially drilled from a first location to a second location. The small diameter pilot hole is disconnected from the drill string and a raise head such as the raise head 10 is connected to the drill string. The drill string is rotated and an axial force is applied to the drill string. The raise head 10 is rotated and drawn along the small diameter pilot hole to form the desired large diameter raise hole.

The drive stem 12 is firmly affixed to the conical main plate 11 by a cylindrical sleeve 14. A cylindrical support plate 13 attached to the main plate 11 provides additional strength and rigidity to the raise head 10. A multiplicity of saddles 16 are mounted on the conical main plate 11. The mounting surface for the saddles 16 is a single continuous plane. This can be set up and machined in one turning operation. Rolling cutters 15 are mounted in the saddles 16. In general, the cutting profile of the rolling cutters 15 is parallel to the surface of the conical main plate 11. The only exception is that at least a pair of the inner cutters adjacent the drive stem 12 are turned inward toward the drive stem. This allows the inner edge of these cutters to be positioned quite close to the drive stem 12. This will insure that there will be very little, if any, uncut bottom next to the drive stem. In circumstances where a small amount of uncut bottom remains between the drive stem and the inner cutters, this uncut bottom portion will easily break away.

Figure 2:
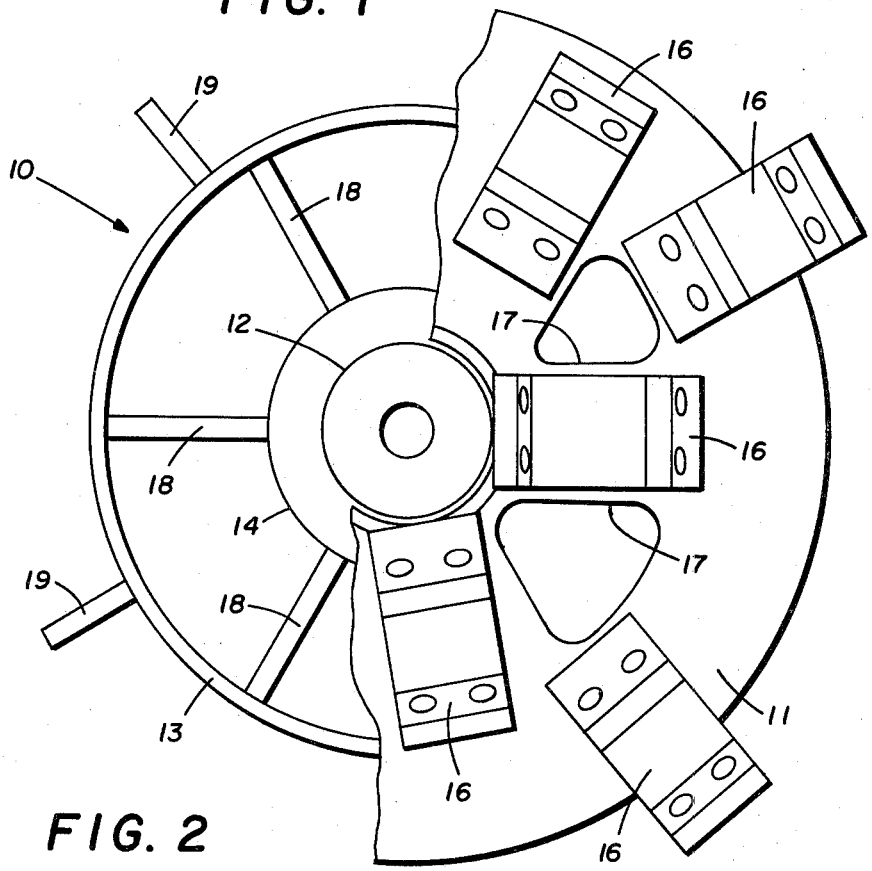
FIG. 2 is a partially cutaway top view of the raise head shown in FIG. 1 with the rolling cutters removed from the saddles.

Referring now to FIG. 2, a top view of the raise head 10 is shown with a portion of the conical main plate 11 cut away. A series of inner struts 18 are positioned between cylindrical support frame 13 and the collar 14. A multiplicity of outer struts 19 extend radially outward from the cylindrical support frame 13. The struts 18 and 19 provide added rigidity and strength to the raise boring head. During the earth boring operation the raise head 10 will tend to be self-cleaning because of the natural tendency of the cuttings to slide toward the outer periphery of the conical main plate 11. An additional self-cleaning effect is provided by a series of openings 17 in the conical main plate 11. This prevents any build-up of debris in the areas adjacent the saddles 16.

The structural details of an embodiment of a raise head 10 constructed in accordance with the present invention having been described, a raise drilling operation will now be considered with reference to FIGS. 1 and 2. The raise drilling operation begins by drilling a small diameter pilot hole through the earth from a first location to an opening at a second location using a small diameter pilot bit. After the pilot hole is completed, the pilot bit is removed from the drill string and a raise head such as the raise head 10 is attached to the drill string. The raise head is rotated and drawn along the pilot hole thereby enlarging the pilot hole to the desired size. The conical main plate 11 and generally conical cutter profile results in the raise head 10 acting to clean itself of all debris falling from the face of the formation being bored. Any debris on the conical main plate 11 tends to move toward the outside of the main plate 11. This tendency is assisted by the rotational action of the raise head 10. The openings 17 in the conical main plate 11 prevent any build-up of cuttings in the areas between the saddles 16. This self-cleaning feature of the raise head 10 results in less wear on the rolling cutters 15 because of the reduction in scrubbing of the rolling cutters 15 against build-up debris. The self-cleaning effect of the raise head 10 also allows the raise head 10 to run smoother during the raise boring operation.

The embodiments of the invention in which an exclusive property or privilege is claimed are defined as follows:

1. A raise head for enlarging a pilot hole into a large diameter hole by disintegrating the formations surrounding the pilot hole into debris and allowing the debris to fall down said large diameter hole, said raise head to be attached to a rotary drill string that extends through said pilot hole, comprising:

a conical main body, said conical main body comprising a truncated cone main plate having a smooth downward sloping outer surface, a central opening and a conical interior;

a drive stem projecting through said central opening and connected to said truncated cone main plate for attachment to said rotary drill string;

a cylindrical support frame positioned in said conical interior of said truncated cone main plate;

a series of inner struts positioned between said truncated cone main plate and said cylindrical support frame;

a multiplicity of outer struts extending radially outward from said cylindrical support frame supporting said truncated cone main plate;

a multiplicity of rolling cutter members for disintegrating the formations into debris and allowing the debris to fall onto said smooth downward sloping outer surface of said truncated cone main plate and continue down said large diameter hole, said rolling cutter members having a cutting profile that is substantially parallel to said downward sloping outer surface of said truncated cone main plate;

a multiplicity of cutter saddles mounted on said smooth downward sloping outer surface of said truncated cone main plate of said conical main body for rotatably supporting said rolling cutter members; and a series of openings in said truncated cone main plate adjacent said cutter saddles.

2. A raise boring head for enlarging a pilot hole into a larger diameter raise hole by disintegrating the formations surrounding the pilot hole into debris and allowing said debris to fall down said raise hole, said raise head to be attached to a rotary drill string, comprising:

a conical main plate, said conical main plate comprising a truncated cone main plate having a smooth downward sloping outer surface, a central opening and a conical interior;

a drive stem projecting through said central opening in said truncated cone main plate for attachment to said rotary drill string;

a cylindrical sleeve positioned around said drive stem affixing said drive stem to said truncated cone main plate;

a cylindrical support frame positioned in said conical interior of said truncated cone main plate and attached to said truncated cone main plate;

a series of inner struts positioned between said cylindrical sleeve and said cylindrical support frame;

a multiplicity of outer struts extending radially outward from said cylindrical support frame supporting said truncated cone main plate;

a multiplicity of cutter saddles mounted on said smooth downward sloping cutter surface of said truncated cone main plate;

a series of openings in said conical main plate adjacent said cutter saddles; and a multiplicity of rolling cutters mounted in said multiplicity of cutter saddles for contacting the formations and disintegrating the formations into debris and allowing said debris to fall onto said smooth downward sloping outer surface of said truncated cone main plate, said rolling cutters having a cutting profile that is parallel to said downward sloping outer surface of said truncated cone main plate except for rolling cutters positioned adjacent said drive stem which have a cutting profile turned inward toward said drive stem.

* * * * *